US007373674B1

(12) United States Patent
Condon

(10) Patent No.: US 7,373,674 B1
(45) Date of Patent: May 20, 2008

(54) TUB SPOUT INSTALLATION SYSTEM

(75) Inventor: Duane R. Condon, Ramona, CA (US)

(73) Assignee: Sioux Chief Mfg. Co., Inc, Peculiar, MO (US)

( * ) Notice: Subject to any disclaimer, the term of this patent is extended or adjusted under 35 U.S.C. 154(b) by 305 days.

(21) Appl. No.: 11/027,063

(22) Filed: Dec. 30, 2004

(51) Int. Cl.
*E03C 1/00* (2006.01)
*E03C 1/04* (2006.01)

(52) U.S. Cl. ..... 4/678; 4/695; 285/902

(58) Field of Classification Search ..... 4/675–678, 4/695; 137/801; 285/902, 307–308, 404, 285/317–318, 90, 195
See application file for complete search history.

(56) References Cited

U.S. PATENT DOCUMENTS

| | | | | |
|---|---|---|---|---|
| 466,255 | A | 12/1891 | Paul | |
| 556,587 | A | 3/1896 | Noack | |
| 1,562,982 | A | 11/1925 | Muend | |
| 1,973,140 | A | 1/1934 | Niedecken | |
| 2,671,355 | A | 3/1954 | Hawkins | |
| 2,912,260 | A | 11/1959 | Wray | |
| 3,136,570 | A | 6/1964 | Lee | |
| 3,190,308 | A | 6/1965 | Winkle et al. | |
| 3,371,679 | A | 3/1968 | Minella | |
| 3,640,305 | A | 2/1972 | Young | |
| 3,884,508 | A | 5/1975 | Jones | |
| 3,913,605 | A | 10/1975 | Ward | |
| 4,486,116 | A | 12/1984 | Sassi | |
| 5,165,121 | A | 11/1992 | McTargett et al. | |
| 5,224,681 | A * | 7/1993 | Lundstrom | 248/410 |
| 5,275,199 | A | 1/1994 | Howell | |
| 6,175,972 | B1 | 1/2001 | Wales | |
| 6,267,145 | B1 | 7/2001 | Sun | |
| 6,301,727 | B1 | 10/2001 | Bertrand et al. | |
| 6,334,463 | B1 | 1/2002 | Lee | |
| 6,378,912 | B1 | 4/2002 | Condon | |
| 6,588,031 | B2 | 7/2003 | Hecker | |
| 6,615,422 | B2 | 9/2003 | Hecker | |

* cited by examiner

*Primary Examiner*—Khoa Huynh
*Assistant Examiner*—Kristie A. Mahone
(74) *Attorney, Agent, or Firm*—Erickson & Kleypas, L.L.C.

(57) ABSTRACT

An improved system for attaching a tub spout to the rough in water supply pipe or stub-out which typically extends out of a tub wall. The improved tub spout includes a vertical ring clamp inside the spout for receiving the stub-out. The stub-out passes through an aperture in the middle portion of the clamp and then into a tubular receiver. By tightening a screw associated with the clamp, the clamp is tilted to engage the stub-out. By further tightening of the screw, the stub-out is drawn into sealed engagement with the interior of the spout and the spout is drawn tightly against the tub wall.

10 Claims, 3 Drawing Sheets

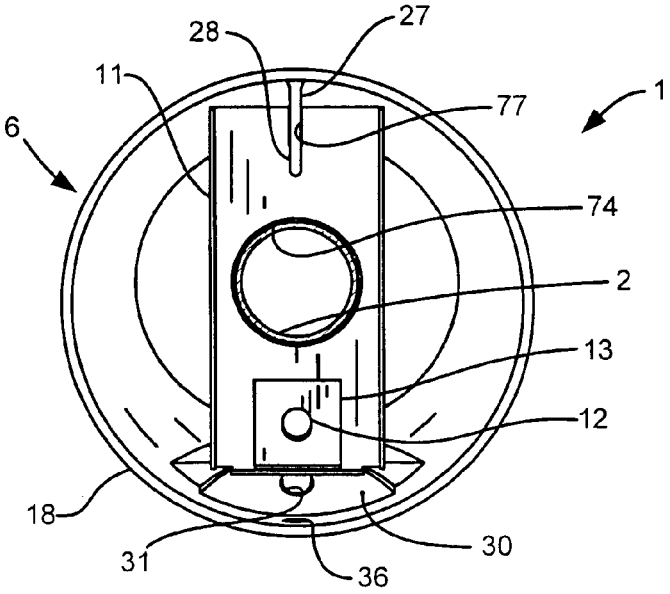
Fig. 8
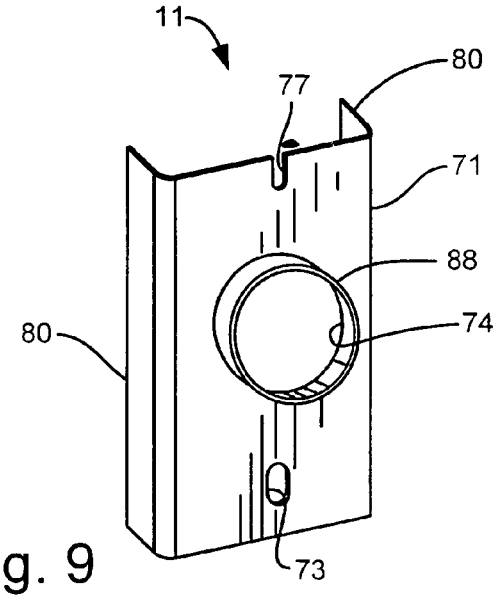
Fig. 9
Fig. 10
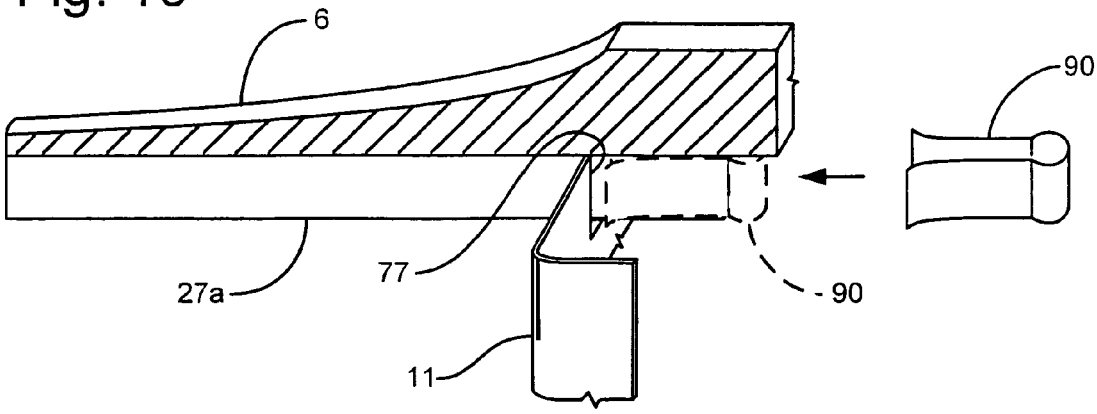

TUB SPOUT INSTALLATION SYSTEM

BACKGROUND OF THE INVENTION

This invention relates to installation of water spouts or faucets, and, more particularly, to a system for connecting a spout such as a tub spout to a water supply pipe or stub-out protruding from a wall such that the spout is concurrently drawn against the wall and sealed against the stub-out by the user tightening a screw.

Water spouts are installed in many household, office and industrial environments. Often they are installed to protrude upward from a countertop or sink surface such as is common with kitchen and bathroom sinks. They may also protrude from a vertical wall surface in proximity to the sink or may be used in association with a bath tub in which case the spout typically protrudes from a wall surface above the tub or from the tub wall itself. The primary embodiment used herein to describe the invention is a tub spout. It should be readily apparent, however, that the disclosed structures could be used as described, or with modifications, in association with sinks or wash basins, or in any other situation where it is desired to deliver water from a supply pipe protruding from a wall surface.

Tub spout installations are typically accomplished using one of two standard methods. In the first, a vertical water supply pipe or line is extended downward from a valve assembly. The supply line is connected to a 90 degree elbow fitting that is securely fastened behind the finished wall and/or tub wall at the precise elevation for the tub spout connection. Typically, a hole in the finished wall and/or tub wall has been previously created at this elevation. A length of threaded test pipe with male threaded nipples on each end is then threaded through the hole and then into the elbow. The material used for the test pipe is often the most inexpensive, such as uncoated, black steel pipe. (Test pipes made of such material are commonly discarded after one use.)

After connection to the elbow, the test pipe is then capped so that the water supply side of the plumbing system can be subjected to pressurized water during the plumbing inspection to ascertain whether or not the system has any leaks. After the pressure test, the test pipe is extracted and a precise length of supply line, also with male threaded nipples on each end, is installed blindly into the elbow fitting enclosed in the finished wall. The tub spout is then typically threaded directly onto the open end of the supply line. It is critical that the end of the threaded nipple is located at the appropriate distance from the surface of the wall, such distance being determined by the distance between the back or bell end of the spout and the internal threading within the spout housing.

In another, more recently developed tub spout installation method, copper or other rigid tubing is stubbed out of the wall. The stub-out may simply consist of a length of copper pipe or may terminate in a sealed, spun closed "bullet" end. In the case of a sealed stub-out, the end may be cut off with a pipe cutter after the pressure test has been completed. Since there are no threads on the end of the stub-out, a slip fit spout must be used that provides a way for sealing the connection between the spout and the stub-out as well as securely affixing the spout to the stub-out. A stub-out of this type affords the advantage that the required distance may be determined just prior to installing the spout. Typically, such spouts are constructed such that length of the stub-out need not be exact.

Although there are various slip fit tub spout designs in the prior art, most utilize an O-ring to form a seal between the exterior of the stub-out and the interior of a collar or tube held within the spout housing. During installation of the tub spout over the stub-out, the O-ring may become abraded or otherwise damaged by a sharp edge or burs on the end of the stub-out. This damage may compromise the ability of the O-ring to seal against the adjoining surfaces. Sealing problems are further exacerbated with diverter spouts because as pressure builds when water is diverted to a shower head, compromised O-ring seals can leak profusely sending a spray or stream of water back towards the wall and into the wall cavity. If the wall cavity becomes moist, particularly if it is wetted repeatedly due to leakage with each use of the tub spout, damage to the wall can occur including mold and mildew.

Most prior art designs also use a set screw that is driven onto (and in some cases mistakenly into) the surface of the stub-out to keep the spout from sliding off. While a set screw may provide a typical means of attachment, it does present problems. If over-tightened, the set screw may be driven too far into the stub-out causing the stub-out to deform or rupture. The surface area between the screw and the stub-out may be quite small (perhaps merely the diameter of the screw), therefore the screw must be held tightly against the stub-out to afford sufficient friction to hold the spout in place. If the screw loosens even slightly, the decrease in holding power may be severely compromised.

Prior art designs place the set screw under and to the rear of the tub spout housing which may make access with a wrench difficult since the access cavity for the set screw typically faces downward and may be in close proximity to the lip of the tub. Therefore, to tighten the set screw the user must thread the associated tool, typically an Allen wrench, between the lip of the tub and the tub spout housing and then position the wrench upward into the set screw cavity to engage the set screw. Within this tight working space, the user must also hold the spout against the wall while tightening the set screw, and, to further complicate matters, rotation of the screw against the stub out often causes the tub spout to "walk away" from the wall.

In the case of spouts having threaded attachment to the stub out, the downward orientation of the discharge outlet is critical and so it is not uncommon for a plumber to rotate the spout away from the wall slightly so that the outlet points in the appropriate direction. Though perhaps slight, the gap formed between the spout housing and the wall can allow substantial infiltration of water behind the spout, through the aperture in the wall formed for passage of the stub-out, and into any space behind the wall or into the wall material itself.

There is an existing need for a system for installing water spouts that provides for ready installation over a stub-out regardless of type of stub-out or of end surface preparation, and in particular there exists a need for a system providing an installation method that allows the spout to be easily and tightly drawn against an associated wall surface to reduce water infiltration due to gaps.

BRIEF DESCRIPTION OF THE INVENTION

Typically, tub spouts are installed by extending a vertical water supply pipe or line downward from a valve assembly behind a wall to meet or form a 90 degree elbow, the horizontal portion of the elbow projecting outward, through the wall at a point immediately above a tub. This horizontal portion of supply line is referred to as being "stubbed out" of the wall and may be referred to herein as a stub-out. The stub-out is typically closed at or following installation to allow for pressure testing of the building's water supply. If the stub-out has a threaded end, it may be capped during pressure testing. The cap is then removed, or the stub-out itself cut behind the cap to the desired length, prior to installation of the tub spout. Alternatively, a tubular stub-out may come pre-formed to terminate in a spun closed "bullet" end that is cut off after pressure testing.

In general, the present invention provides an improved method and apparatus for attaching a tub spout to a tubular stub-out so that the back end of the spout is drawn tightly against the wall while a water tight seal is also formed around stub-out within the interior of the spout. The improved tub spout apparatus includes a ring clamp mounted inside the spout having an aperture for receiving the stub-out. The stub-out passes through the aperture in the middle portion of the ring clamp and then into a tubular stub-out receiver. By tightening a screw (also referred to herein as a bolt) associated with the ring clamp, the stub-out is drawn into the spout thereby drawing the spout against the tub wall. As the stub-out is drawn into the spout, an O-ring is compressed against and between the outer surface of the stub-out and an inner surface of the receiver to form a water tight seal.

Other advantages of the invention will become apparent from the following description taken in connection with the accompanying drawings, wherein is set forth by way of illustration and example embodiments of the present invention.

BRIEF DESCRIPTION OF THE DRAWINGS

FIG. 8 is a rear elevational view of the tub spout installation system in the direction of the arrows along the line 8-8 in FIG. 4.

FIG. 9 is a front perspective view of an alternative embodiment of the ring clamp.

FIG. 10 is a partial section of the tub spout housing illustrating positioning of the stop clip upon the rearward portion of the rail.

DETAILED DESCRIPTION

As required, a detailed embodiment of the present invention is disclosed herein; however, it is to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
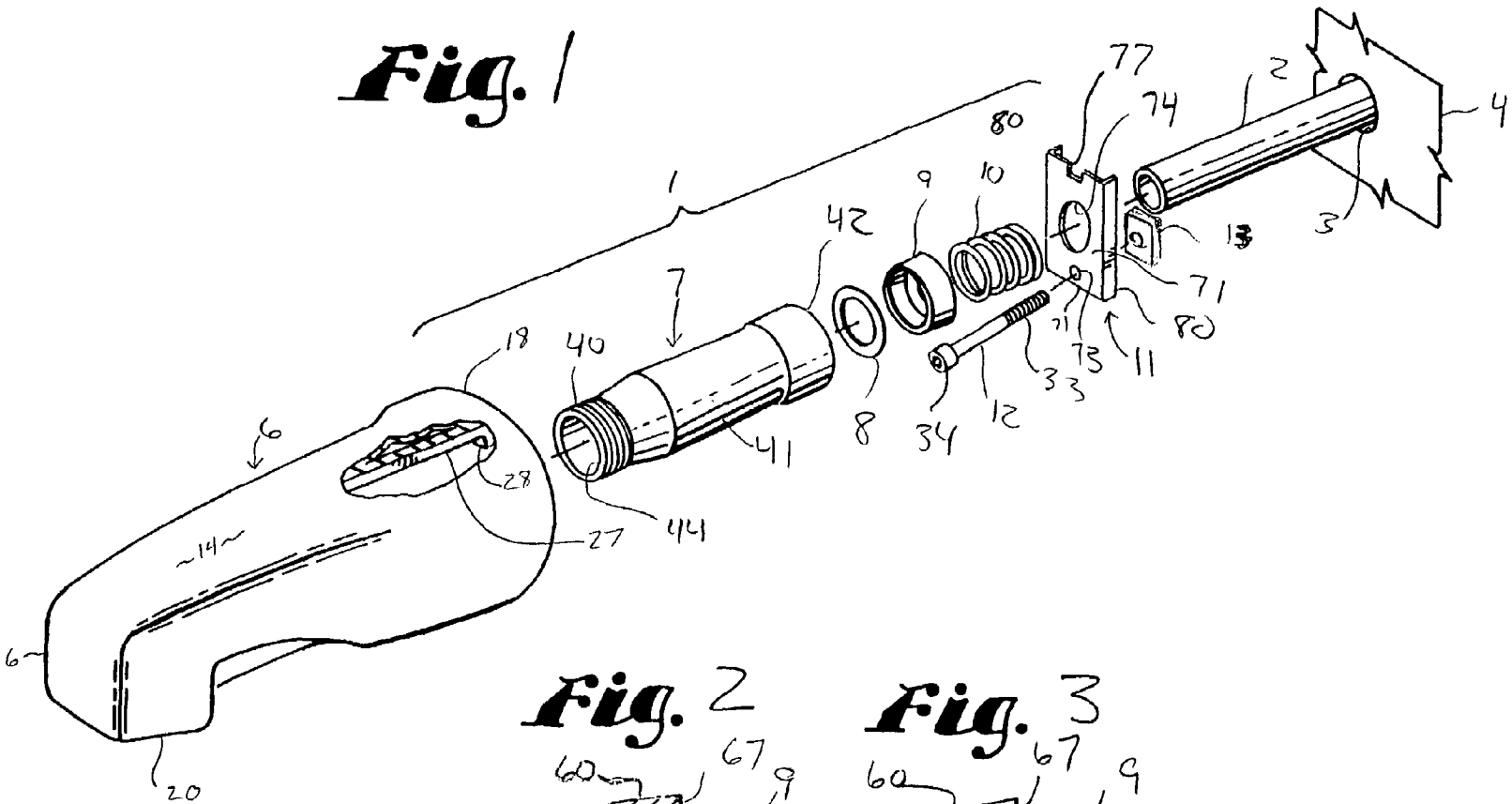
FIG. 1 is a partial, exploded, perspective view of an embodiment of the tub spout installation system.

Referring now to the drawings, and in particular to FIG. 1, a partial, exploded view, there are shown components of an embodiment of a tub spout installation system or tub spout assembly 1 which is adapted for connection to a stub-out 2 or the like extending through a hole 3 in a wall 4. The stub-out 2 is connected to a water supply line 5 which is connected to a valve not shown. The tub spout assembly 1 comprises a generally tubular drain spout housing 6, a tubular stub-out receiver or adaptor 7, an O-ring 8, a beveled washer or compression ring 9, a coil spring 10, a clamping plate 11, a screw 12 and a nut 13. The clamping plate 11 may also be referred to as a ring clamp, pipe clamp or clamping member.

The tubular drain spout housing 6 generally comprises a continuous outer wall 14 having a relatively narrow front end or discharge end 16 and a flared or bell-shaped back end or inlet end 18. The front end or discharge end 16 has an outlet 20 which is generally at a right angle to the longitudinal axis of the housing 6 for deflecting water emitted from the outlet 20 downward into an associated tub (not shown). Rearward of the outlet 20 is a dividing wall 24 that extends vertically across the interior of the housing 6 proximate to the outlet 20. A bore 25 extends through the dividing wall 24 and through a threaded collar 26 mounted on, or integral with, the dividing wall 24.

Figures 4, 5, 6, 7:
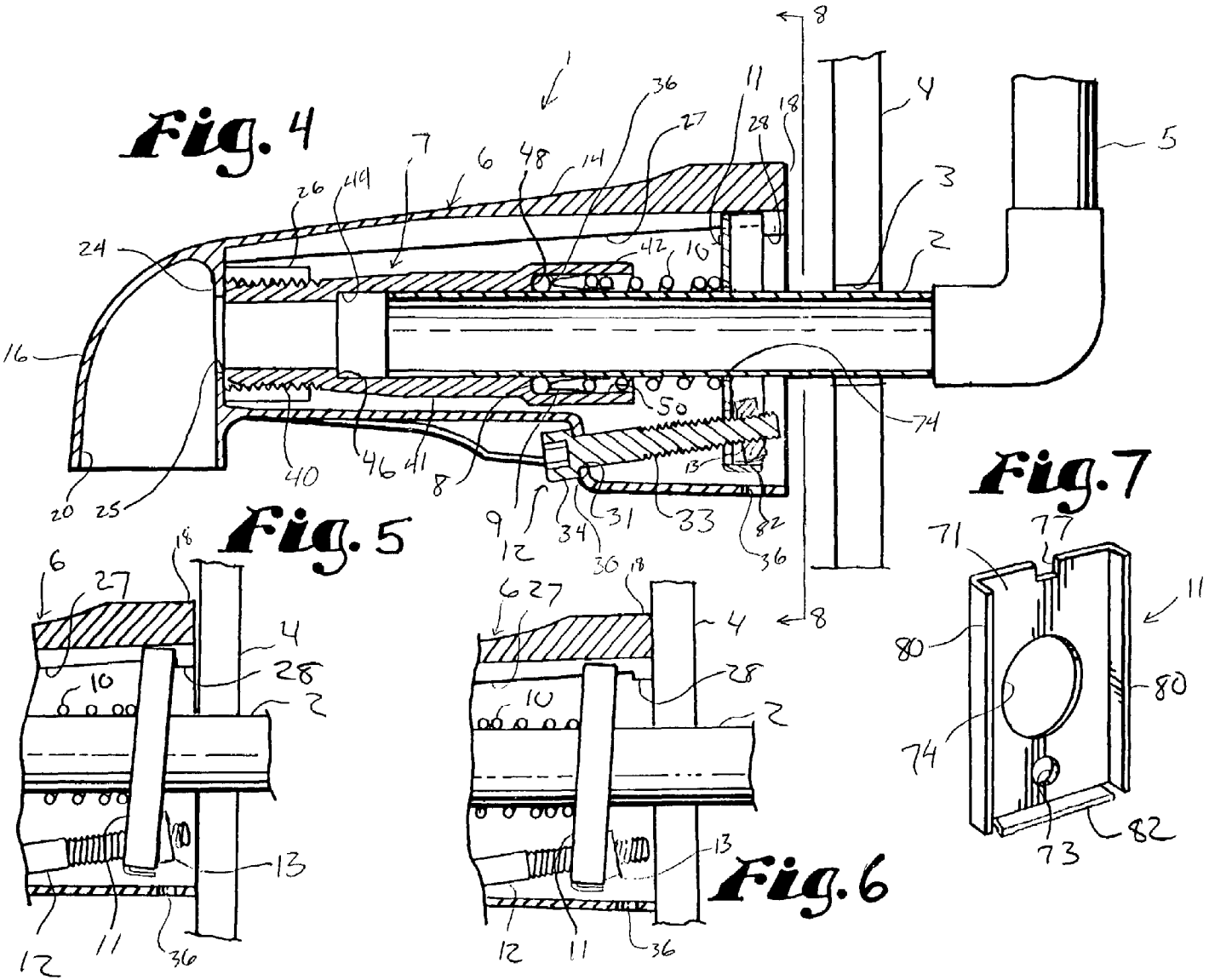
FIG. 4 is a cross sectional view of the tub spout installation system.
FIG. 5 is a partial section of a detailed view of the ring clamp in a canted position.
FIG. 6 is a partial section of a detailed view of the ring clamp drawn forward from the pivot stop.
FIG. 7 is a rear perspective view of the ring clamp.

As shown in FIGS. 1 and 4, a rail 27 is attached to, or projects downward from the upper, interior portion of the spout housing 6. The rail 27 generally extends from the dividing wall 24 to the back end 18 of the spout housing 6, substantially parallel to the longitudinal axis of the housing 6. A stop 28 is located proximate to, or is formed on, a rear end of the rail 27 and is shown as having the same width as the rail 27, but projecting downward from the rail 27. The stop 28 cooperates with the screw 12 to hold the pipe clamp 11 within the housing 6 against the biasing force of the spring 10 as described in more detail below.

A generally vertically extending bearing surface or wall 30 is formed in the spout housing 6 on the lower side thereof. A hole 31, sized to receive a partially threaded stem 33 of the screw 12, is formed in the bearing surface 30. The hole 31 is smaller than a head 34 of the screw 12, such that an inner surface of the screw head 34 may be positioned in abutting relationship with the bearing surface 30 of housing 6. The stem 33 of the screw 12 is threadingly connected to the pipe clamp 11 as described in more detail below.

As shown in FIGS. 4-6, and 8, a weep hole 36 may be provided in the lower wall of the housing to allow for drainage of any water the may collect within the housing.

The tubular adaptor 7 includes a threaded front end or nipple 40, a middle section 41 and a radially expanded rear end or seal receiver 42 with an internal bore 44 extending through the adaptor 7. The threaded nipple 40 is sized for threaded connection in the threaded collar 26 in the tub spout housing 6. The threaded nipple 40 provides a sealed, fluid connection between the adaptor 7 and the outlet 20 of spout housing 6. An internal diameter of the middle section 41 of the adaptor 7 is sized to be slightly larger than the external diameter of the stub-out 2 such that the middle section 41 may be slid over the stub-out 2. A first annular shoulder 46 is formed in the adaptor 7 along the internal bore 44, between the threaded nipple 40 and the middle section 41. A second annular shoulder or O-ring seat 48 is formed in the adaptor 7 along the internal bore 44 between the middle section 41 and the seal receiver 42.

The rear end or seal receiver 42 of the adaptor 7 is wider than the middle section 41 and is sized such that an annular gap 50 is formed between the seal receiver 42 and a stub-out 2 to which the tub spout assembly 1 is attached. The annular gap 50 is sized to receive the O-ring 8, the compression ring 9 and the coil spring 10 which generally form a sealing assembly or sealing means for forming a watertight seal between the stub-out 2 and the adaptor 7. The O-ring 8 is positioned or seated against the second annular shoulder 48 within the adaptor 7. The internal diameter of the O-ring 8 is sized to be slightly smaller than the outer diameter of the stub-out 2 such that a water tight seal is formed between the O-ring and the stub-out 2 when the tub spout assembly 1 is slid onto the stub-out 2.

The compression ring 9 is positioned in the seal receiver 42 behind the O-ring 8. The coil spring 10 is positioned between the compression ring 9 and the ring clamp 11, such that the coil spring 10 engages and biases a front end of the compression ring 9 against the O-ring 8 to compress the O-ring 8 against the O-ring seat 48 to form a watertight seal between the O-ring 8 and the adaptor 7.

Figure 2:
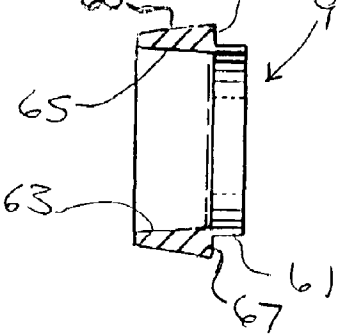
FIG. 2 is an enlarged cross section of the beveled washer.
Figure 3:
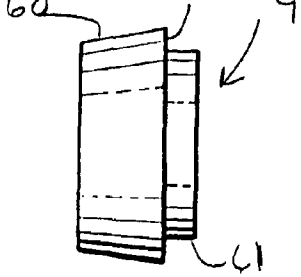
FIG. 3 is an elevational view of the beveled washer of FIG. 2.

As shown in enlarged views in FIGS. 2 and 3, the compression ring 9 includes a front section 60 and a rear section 61 with a bore 63 extending therethrough and defined by inner wall 65. As shown in FIG. 2, the inner wall 65 of compression ring 9 slopes inward from the front end of the front section 60 and toward the rear section 61 to form a wedge-like structure. The rear section 61 of the compression ring 9 has a reduced outer diameter relative to the front section 60 forming a rearwardly facing shoulder 67 between the rear section 61 and the front section 60. A front end of the coil spring 10 is secured around the rear section 61 of the compression ring 9 and bears against the shoulder 67 biasing the compression ring 9 against the O-ring 8. Because of the wedge-like shape of the front end of the compression ring front section 60, biasing of the front section 60 against the O-ring 8 presses the O-ring both forward against the second annular shoulder 48 of adaptor 7 and inward against the stub-out 2 to help ensure a water tight seal between the stub-out 2 and the adaptor 7.

The ring clamp 11 is positioned behind the spring 10 and generally comprises a rectangular plate 71 with a small, lower aperture 73 for receiving the screw 12 and a large, centrally located aperture 74 sized to receive the stub-out 2 projecting from the hole 3 in wall 4. A notch or slot 77 extends into the rectangular plate 71 from an upper edge thereof. The slot 77 is sized to slidably receive rail 27. The side edges of the ring clamp 11 are bent rearward to form side flanges 80 which provide rigidity and strength to the clamp 11. Similarly, a bottom edge of the ring clamp 11 is bent rearward to form a bottom flange 82. The screw 12 passes through the lower aperture 73 and then threadably engages the nut 13 positioned behind the rectangular plate 71. The lower aperture 73 is sized to be larger than the threaded stem of the screw 12 to permit the screw 12 to pivot relative to the lower aperture 73 as generally shown in FIGS. 4-6 and discussed in more detail hereafter. The lower aperture 73 may be shaped as an oval with the longer axis oriented vertically to further provide room for the screw to pivot (see FIG. 9). A flattened side of the nut 13 is positioned adjacent the bottom flange 82 to prevent the nut 13 from turning as the screw 12 is rotated relative to the nut 13.

As an alternative to the square nut 13 illustrated, a cylindrical nut (not shown) may be used having a threaded bore passing transversely through, and perpendicular to, the longitudinal axis of the cylindrical nut. The cylindrical nut is sized to fit closely between the side flanges 80 of the clamp 11 to prevent it from spinning as the screw 12 is turned. The round profile of the cylindrical nut allows it to turn or roll against the proximate surface of the plate 71, thereby maintaining axial alignment between the stem 33 of the screw 12 and the bore of the cylindrical nut as the clamp 11 is pivoted by rotation of the screw 12.

As seen in FIGS. 4 and 8, the centrally located or large aperture 74 is sized to be just slightly larger than the outer diameter of the stub-out 2 to permit the clamp 11 to be slid over the stub-out 2 when the rectangular plate 71 of clamp 11 is oriented perpendicular to the stub-out 2. Referring to FIG. 9, a forwardly extending annular shoulder or lip 88 may be formed in the rectangular plate 71 around the central aperture 74. The rear end of the spring 10 may then be seated around the annular lip 88 to center the spring 10 around the central aperture 74.

The tub spout assembly 1 is assembled prior to attachment to the stub-out 2. In particular, the adaptor 7 is threaded into the threaded collar 26 of the spout housing 6. The O-ring 8 is inserted into the adaptor seal receiver 42. The rear section 61 of the compression ring 9 is inserted into the front end of the coil spring 10 and then the front end of the compression ring is inserted in the adaptor seal receiver 42. The clamping plate 11 is then inserted into the housing 6 by angling the rectangular plate 71 through the housing back end 18 and advancing its upper end toward the rail 27 and in front of the stop 28 until the rail 27 extends into the slot 77. The rectangular plate 71 is then angled forward against the biasing force of the spring 10 until the plate 71 is generally vertical with the spring 10 biasing the rectangular plate 71 against the stop 28. The stem 33 of the screw 12 is inserted through the hole 31 in bearing surface 30, through the lower aperture 73 in rectangular plate 71 and through nut 13. The screw 12 is then rotated and threaded through the nut 13 until the rectangular plate 71 extends generally perpendicular to a longitudinal axis of the spout housing 6 and the head 34 of the screw 12 abuts against the bearing surface 30 on housing 6.

Referring to FIG. 10, the embodiment shown therein includes a stop clip 90 which is removably securable to a rail 27*a* to facilitate assembly. In particular, the stop 90 may be removed from the rail 27*a* to permit the clamping plate 71 to be slid onto the rail 27*a* without having to angle the clamping plate 71 past a fixed stop such as stop 28 (to which the stop clip 90 is presented as an alternative). Once the rectangular plate 71 is slid onto the rail 27*a* the stop 90 may be attached to the rail 27*a* to hold the clamping plate 11 in position and on the rail 27*a*.

The assembled tub spout assembly 1 may then be slid onto the end of a stub-out 2 as generally shown in FIG. 4 with the stub-out 2 extending through the central aperture 74 in the clamping plate 11, through the coil spring 10, compression ring 9 and O-ring 8 and into the internal bore 44 in the adaptor 7. The tub spout assembly 1 is generally pushed onto stub-out 2 until the back end 18 of the housing 6 abuts against the wall 4 through which the stub-out 2 extends. Referring to the embodiment of the clamp 11 shown in FIG. 9, the lip 88 facilitates sliding of the tub spout assembly 1 onto the stub-out 2, by holding the spring 10 centered around the aperture 74. If the spring 10 is not held centered around the aperture 74, the rear end of the spring 10 may tend to flex relative to the hole, typically downward such that a portion of the spring's coils extend across the aperture 74 and impede sliding of the spring 10 around the stub-out 2.

The tub spout assembly 1 is locked, clamped or fixedly secured to the stub-out 2 by then rotating the screw 12 clockwise (assuming conventional threading patterns on the screw 12 and in the nut 13) drawing or pivoting the lower portion of the clamp plate 11 forward. As the lower end of the clamp plate 11 is being drawn forward, the biasing force of the spring acting on the clamp plate 11 urges the upper end of the clamp plate 11 rearward against the stop 28 thereby causing the clamp plate 11 to tilt or pivot relative to the stub-out 2. As this occurs, the screw stem 33 is allowed to pivot within the oversized, lower aperture 73 in plate 71. In the embodiment shown, the clamp plate 11 pivots about an axis extending through the interface between the upper end of the clamp plate 11 and the stop 28. This axis generally extends transverse to the longitudinal axis of the stub-out 2.

Tilting of the clamp plate 11 relative to the stub-out 2 reduces the overall height of the aperture 74 relative to the diameter of the stub-out 2. As the screw 12 is threaded further into the nut 13 the clamp 11 continues to tilt until the upper and lower edges of the portion of the plate 71 forming the central aperture 74 contact and grip or grab the outer surface of the stub-out 2, fixing the position of the clamp 11 relative to the stub-out 2.

Once the clamp 11 is thus engaged with the stub-out 2, further tightening of the screw 12 drives the housing 6 rearward relative to the stub-out 2 and clamp 11 as generally shown in FIGS. 5 and 6. The interconnection of the housing 6 to the clamp 11 through the spring 10 permits the housing 6 to slide rearward relative to the clamp 11 with the rail 27 in housing 6 sliding through the slot 77 in the clamp 11. The abutment of the screw head 34 against the bearing surface 30 on the housing 6 provides the mechanism for driving the housing rearward relative to the clamp 11. Eventually, through tightening of the screw 12, the tub spout housing 6 is drawn rearward until the back end 18 of the housing 6 closely abuts and is held firmly against the adjacent surface of the wall 4.

Referring again to FIG. 4, it may be seen that as the housing 6 is driven rearward, the spring 10 is compressed between the clamp 11 and adaptor 7. Further compression of the spring 10 transmits increased pressure to the compression ring 9 which increases the pressure exerted by the compression ring 9 against the O-ring 8 and in turn increasing the pressure of the O-ring against the stub-out 2 and adaptor 7 to increase the seal formed therebetween. If the O-ring 8 becomes damaged by a sharp edge of the stub-out 2 during initial insertion of the stub-out 2 into the tub spout assembly 1, the above referenced compression and resulting deformation of the O-ring 8 will tend to substantially mitigate such damage and allow the O-ring 8 to form a water tight seal around the stub-out 2.

Therefore, through the single action by the user of driving the screw 12, the housing 6 becomes fixedly attached to the stub-out 2 and the back end 18 of the housing 6 is driven rearward and tightly against the wall 4 through which the stub-out extends, thereby reducing opportunities for water infiltration behind the tub spout 1. At the same time, and through the same action by the user, a water tight seal is formed between the stub-out 2 and the tub spout assembly 1 through compression of the O-ring 8.

It is to be understood that while certain forms of this invention have been illustrated and described, it is not limited thereto except insofar as such limitations are included in the following claims and allowable equivalents thereof. For example, the central aperture 74 may be purposely formed to be somewhat oval or elliptical in shape, with the major axis oriented vertically and the minor axis oriented horizontally. The minor axis may closely approximate the diameter of the stub-out 2 since the area of contact (and corresponding resistance due to friction) between sides of the stub-out 2 and the vertical sides of the aperture 74 must necessarily be small due to the oval shape of the aperture 74 and the typically circular profile of the stub-out 2. As the clamp 11 is canted during tightening of the screw 12, however, the oblique projection of the central aperture 74 upon the stub-out 2 becomes increasingly circular until the top and bottom portions of the central aperture 74 contact the stub-out 2. At this point the stub-out 2 is essentially (allowing for minute gaps due to imperfections) in contact with all sides of the central aperture 74 creating an extremely strong and slip-resistant attachment to the tub spout assembly 1.

What is claimed is:

1. A spout assembly adapted for connection to a water supply line extending through a hole in a wall; said spout assembly, comprising:

a) a generally tubular housing having a rearward inlet and a forward outlet;

b) a pipe clamp moveably secured within said housing proximate to said inlet and having a generally circular opening for receiving the water supply line;

c) means for tilting said clamp to engage the water supply line, and for moving said housing rearward toward the hole in the wall subsequent to engagement of the water supply line by said clamp, whereby said movement of said housing rearward toward the hole in the wall draws the water supply line further into said housing;

e) a receiver secured within said housing, said receiver comprising a generally tubular structure in axial alignment with said housing and having an open front end in communication with said outlet and a back end adapted to receive the water supply line;

f) an annular seal disposed within said receiver to accept and surround the water supply line and positioned rearward of an internal shoulder formed in said receiver; and g) a compression ring sized to accept the water supply line, said compression ring disposed within said receiver rearward of said seal, wherein rearward movement of said housing toward the hole in the wall compresses said annular seal between said receiver internal shoulder and said compression ring.

2. The system of claim 1 further comprising a spring sized to accept said supply line, said spring located within said receiver rearward of said compression ring and forward of said clamp, whereby upon rearward movement of said housing toward the hole in the wall, pressure is brought to bear upon said spring causing said spring to bias said compression ring forward and against said seal.

3. The system of claim 1 wherein said means for tilting said clamp comprises a screw threadably engaged with said clamp, whereby upon axial rotation of said screw said clamp is tilted.

4. The system of claim 3 wherein said screw includes a head and a stem that is at least partially threaded, said stem extends through a hole in said housing with said head of said screw abutting against an exterior bearing surface of said housing, said stem also extends through a hole in said clamp and threadingly engages a threaded receiver engaging said clamp such that upon rotation of said screw at least a portion of said clamp is drawn from a rearward position to a more forward position within said housing causing said clamp to pivot relative to and engage said pipe fixing the relative position of the clamp to said pipe and further rotation of said screw drives the housing rearward toward the hole in the wall.

5. The system of claim 1 wherein said clamp is slidably engaged with a rail formed on and projecting inward within said housing, said rail disposed generally parallel to the longitudinal axis of said housing.

6. The system of claim 5 wherein said rail comprises a ridge projecting downward from an upper, interior portion of said housing.

7. The system of claim 5 wherein said clamp further comprises means for slidable engagement with said rail.

8. A spout assembly adapted for connection to a stub-out extending through a hole in a wall, said spout assembly comprising:

a) a hollow spout housing having a discharge end and an inlet end;

b) a stub-out receiver mounted within said housing in fluid communication with said discharge end thereof; said stub-out receiver sized to receive a stub-out extending through said inlet end of said spout housing;

c) a seal forming a seal between said stub-out receiver and the stub-out received therein;

d) a clamping plate having a stub-out receiving aperture extending therethrough; said stub-out receiving aperture sized to receive the stub-out received within said stub-out receiver when said clamping plate extends in a first orientation relative to the stub-out; said clamping plate slidably mounted relative to said spout housing;

e) a bolt extending through a bolt hole formed in a bearing surface on said spout housing, said bolt having a threaded stem extending through a hole in said clamping plate, said bolt further having a bolt head positioned proximate said bearing surface on said spout housing;

f) said threaded stem of said bolt threadingly connected to a nut positioned adjacent to said hole and engaging said clamping plate, such that rotation of said bolt in a selected direction draws said nut and a portion of said clamping plate toward said bearing surface, pivoting said clamping plate relative to the stub-out extending therethrough such that portions of said clamping plate surrounding said stub-out receiving aperture are advanced into engagement with the stub-out to fix the position of said clamping plate relative to the stub-out, and further rotation of said bolt in said selected direction drives said spout housing rearward toward the hole in the wall.

9. A spout assembly adapted for connection to a stub-out extending through a hole in a wall, said spout assembly comprising:

a) a hollow spout housing having a discharge end and an inlet end;

b) a stub-out receiver mounted within said housing in fluid communication with said discharge end thereof; said stub-out receiver sized to receive a stub-out extending through said inlet end of said spout housing;

c) a clamping plate having a stub-out receiving aperture extending therethrough; said stub-out receiving aperture sized to receive the stub-out received within said stub-out receiver when said clamping plate extends in a first orientation relative to the stub-out; said clamping plate slidably mounted relative to said spout housing;

e) a bolt extending through a bolt hole formed in a bearing surface on said spout housing, said bolt having a threaded stem extending through an opening in said clamping plate, f) said threaded stem of said bolt threadingly connected to a nut positioned adjacent to said opening in said clamping plate and engaging said clamping plate, such that rotation of said bolt in a selected direction draws said nut and a portion of said clamping plate toward said bearing surface, pivoting said clamping plate relative to the stub-out extending therethrough such that portions of said clamping plate surrounding said stub-out receiving aperture are advanced into engagement with the stub-out to fix the position of said clamping plate relative to the stub-out, and further rotation of said bolt in said selected direction once said position of said clamping plate is fixed relative to the stub-out generates forces on said spout housing bearing surface to drive said spout housing rearward relative to said clamping plate and toward the hole in the wall.

10. The spout assembly as in claim 9 further comprising:

a) an annular seal disposed within said receiver to accept and surround the stub-out and positioned rearward of an internal shoulder formed in said stub-out receiver;

b) a compression ring sized to accept the water supply line, said compression ring disposed within said receiver rearward of said seal, and c) a spring sized to accept said stub-out, said spring having a first end located within said receiver rearward of and in abutting relationship with said compression ring and a second end forward of and in abutting relationship with said clamping plate, said spring biasing said compression ring toward said annular seal wherein rearward movement of said housing relative to said clamping plate compresses said annular seal between said receiver internal shoulder and said compression ring.

* * * * *